United States Patent [19]

Kitamura

[11] 4,393,647

[45] Jul. 19, 1983

[54] SNAIL WIRE ARRANGEMENT FOR YARN BREAKAGE DETECTION IN RING FRAMES

[76] Inventor: Yohji Kitamura, 1-18, Deguchi 1-chome, Hirakata-shi, Osaka, Japan

[21] Appl. No.: 296,424

[22] PCT Filed: Feb. 26, 1981

[86] PCT No.: PCT/JP81/00036

§ 371 Date: Aug. 20, 1981

§ 102(e) Date: Aug. 20, 1981

[87] PCT Pub. No.: W081/02433

PCT Pub. Date: Sep. 3, 1981

[30] Foreign Application Priority Data

| | | | |
|---|---|---|---|
| Feb. 27, 1980 | [JP] | Japan | 55-25200 |
| Dec. 4, 1980 | [JP] | Japan | 55-174238 |
| Dec. 4, 1980 | [JP] | Japan | 55-174239 |

[51] Int. Cl.[3] ..... D01H 13/16

[52] U.S. Cl. ..... 57/81; 200/61.18; 242/157 C

[58] Field of Search ..... 57/80, 81; 200/61.18, 200/61.13; 226/11, 24, 45; 242/28, 29, 36, 37 R, 49, 157 R, 157 C

[56] References Cited

U.S. PATENT DOCUMENTS

| | | | |
|---|---|---|---|
| 3,132,466 | 5/1964 | Preisser | 57/81 |
| 3,688,958 | 9/1972 | Rydborn | 57/81 X |
| 3,968,637 | 7/1976 | van Andel et al. | 57/81 |
| 4,254,613 | 3/1981 | Arita et al. | 57/81 |

FOREIGN PATENT DOCUMENTS

| | | |
|---|---|---|
| 40-6579 | 2/1965 | Japan . |
| 49-32269 | 8/1974 | Japan . |
| 50-138140 | 11/1975 | Japan . |
| 52-18296 | 5/1977 | Japan . |
| 52-85531 | 7/1977 | Japan . |
| 53-78348 | 7/1978 | Japan . |
| 54-42427 | 4/1979 | Japan . |
| 54-139725 | 9/1979 | Japan . |
| 54-151636 | 11/1979 | Japan . |
| 55-2509 | 1/1980 | Japan . |
| 55-13957 | 1/1980 | Japan . |

*Primary Examiner*—John Petrakes

*Attorney, Agent, or Firm*—Oblon, Fisher, Spivak, McClelland & Maier

[57] ABSTRACT

In order for the snail wire that is to be fitted on a ring-frame for detection of yarn breakage to sense sharply the intrinsical vibration resulting from its contact with yarn, the flat portion of the snail wire where the piezo-electric element is mounted is modified so as to sense the vibration more easily and furthermore, the piezo-electric element and connecting lead are covered and retained with elastic material for protection to thereby ensure the yarn breakage detecting snail wire which can be used stably throughout a long period.

3 Claims, 17 Drawing Figures

SNAIL WIRE ARRANGEMENT FOR YARN BREAKAGE DETECTION IN RING FRAMES

TECHNICAL FIELD

The present invention relates to an improved snail wire arrangement with a higher sensitivity which is utilized for a yarn breakage detector for detecting yarn breakage during spinning in a ring spinning frame.

BACKGROUND ART

Commonly, snail wires provided on a ring frame produce inherent or unique vibrations when they are brought into contact with the spinning yarns i.e. yarns being spun. For detecting the yarn breakage in the ring frame through detection of such vibrations as described above, there has conventionally been proposed a yarn breakage detector in which piezo-electric elements are attached to the snail wires for deriving necessary signals therefrom.

On the other hand, in ring frames or similar spinning machines, early detection of yarn breakage is of vital importance to increase the production, minimize faulty yarns, and prevent various problems in advance.

For the above purpose, there have been already known various yarn breakage detecting means, which may be classified into such types as utilizing variations due to yarn breakage by contacting a feeler with the spinning yarns, employing a photoelectric tube, or based on dielectric constant, etc. Meanwhile, the detecting means as described above are broadly divided into one kind in which the yarn breakage portions are detected while detectors are being moved along a large number of spinning yarn lines, and the other kind in which counterparts of the detectors are provided on individual spinning parts.

However, the former or moving type requires a device for moving and guiding the detectors, and, in particular, a considerable investment for applying the detectors to the existing frames. Therefore, the latter type in which the counterparts are disposed on the individual spinning parts is preferable. Furthermore, the above described photoelectric tube type or dielectric constant type is not only expensive, but is not suitable for practical applications, since improper decisions may result from accumulation of flies, etc. Moreover, it is almost impractical to dispose the detectors on the individual spinning parts from an economic point of view. Accordingly, there is a requirement for the detecting means which may be disposed on the individual spinning parts, and yet, readily applicable to the existing frames.

On the other hand, snail wires are disposed on such ring frames for guiding spinning yarns onto take-up bobbins, and produce vibrations when coming into contact with the spinning yarns, and therefore, there has also been proposed means for detecting the yarn breakage through detection of such vibrations by a piezo-electric element. Furthermore, since the above vibrations include those due to contact with the spinning yarns, and those arising from mechanical vibrations of the ring frame, there is also known another arrangement which discriminates these vibrations for detection.

For example, in the yarn breakage detecting device of U.S. Pat. No. 4,254,613 filed May 16, 1979, as shown in FIGS. 1 to 7, the spinning yarn Y is drawn out from between front rollers 1, 1', and is wound onto a bobbin 8 while being guided by a snail wire 2. Meanwhile, the spinning yarn Y is wound onto the bobbin 8 through a ring 5 supported by a ring rail 4 for simultaneous vertical movements therewith and a traveller 6 movably mounted on the ring 5, so as to form a cop 7, with an antinode ring 9 being further provided as shown. Each snail wire 2 is mounted on a lappet 3, which is, in turn, disposed on a lappet bar 10. The snail wire 2 is attached to the lappet 3 so that the position of its yarn guide portion may be changed, while the lappet bar 10 is so provided as to be vertically movable by a slight distance along a support spindle of the bobbin 8. For the detection of yarn breakage, a piezo-electric element 12 is fixed to a portion of the snail wire 2 for deriving electrical power produced in the piezo-electric element for effecting the individual detection. Meanwhile, by contact with the spinning yarn Y, the snail wire is subjected to vibrations at high frequencies, which also include the mechanical vibrations of the frame in the range of approximately 5 to 15 KHz, and thus, the snail wire is actually subjected to the vibrations as large as about 15 KHz. In connection with the above, it has been further found that the above vibrations are those inherent in the snail wire, and are not much influence by the contact pressure with respect to the spinning yarn Y or the running speed of the spinning yarn Y. Accordingly, in the present invention, it is intended to detect the yarn breakage by distinguishing the above inherent vibrations from the mechanical vibrations, through detection. For the purpose of deriving the electromotive force of the piezo-electric element 12, as shown in FIG. 2, the snail wire 2, lappet 3 and signal transmission means are mounted on the lappet bar 10, with the lappet 3 being fixed to said lappet bar 10 through an insulating plate 16 and a wiring board 15 provided at the rear face side thereof. Moreover, the lappet 3 is hingedly mounted on a lappet bracket 13, while the snail wire 2 is adjustably provided at the front face side thereof for projection or retraction as desired. As shown in FIG. 4, the piezo-electric element 12 is fixed. by a bonding material, to one flattened side of the snail wire 2. It is preferable that the snail wire 2 is elastically supported by a holder 21 through an elastic or resilient support material or member 11. As is seen in FIG. 5, the holder 21 is formed into a hollow tubular member, while a pair of grooves 22, 22 (the groove at the other side is not shown here) are provided in opposite side walls thereof, with lead wires of said piezo-electric element 12 being connected to corresponding electrically conductive plates 121 which are provided in said grooves 22. Such snail wire 2 as described above is formed together with the holder 21 as a replacement part.

On the other hand, in the under surface of the lappet 3, a slide hole 32 is provided to receive the holder 21 for supporting, while a U-shaped member indicated at 40 is inserted into the slide hole 32 from the rear side. The holder 21 and the U-shaped member 40 are both molded from an insulating material, and in the inner sides of projecting portions 41 of the U-shaped member 40, grooves 42 are respectively formed. The grooves 42 extend through the corresponding projecting portions 41, with openings 43 being provided at the end portions thereof. Meanwhile, into the grooves 42 and openings 43 thus formed, electrically conductive wires 46 are respectively inserted so as to extend therethrough. Each of the wires 46 is formed with a coiled portion 44, a terminal portion 14, and a contact portion 47 which is formed by being resiliently bent inwardly from the groove 42 as is most clearly seen in FIG. 5, and is arranged to be inserted, from the side of its contact portion 47, into the groove 42 and the opening 43. Moreover, into the coiled portions 44, 44, reduced diameter portions 35, 35 formed at opposite ends of a eylindrical member 34 made of an insulating material are inserted, with collar rings 36, 36 formed by a similar insulating material being further disposed at the opposite sides thereof, for insertion from the rear side of said slide hole 32. Furthermore, a stopper projection 45 extends upwardly from the rear side wall of the U-shaped member 40, so as to restrict the inserting position.

On the other hand, the bracket 13 of the lappet 3 is formed with a pair of hinge pin supporting portions 131, 131 on its rear wall, and also with lappet support arms 133, 133 extending inwardly from opposite ends thereof, with an elongated opening 132 being provided at approximately the central portion of its rear wall as shown. Meanwhile, at the rear side edge of the lappet 3, there are formed a pair of hinge shaft bearing portions 31, 31.

For assembly, the U-shaped member 40 earlier described is assembled into the slide hole 32 through insertion, while the cylindrical member 34 is disposed between the shaft support portions 131, 131 of the bracket 13, and then, a support shaft 33 is pushed into the bearing portions 31 of the lappet 3, shaft support portions 131 and cylindrical member 34 so as to extend therethrough. When the holder 21 earlier described has been inserted into the slide hole 32 of the lappet 3 thus assembled, the arrangement is provided as shown in FIG. 4, and the leads of the piezo-electric element 12 are connected to the terminal portions 14, 14 of the wires 46 through said wires.

In the case where the yarn breakage detecting lappet 3 is to be mounted on the existing lappet bar 10, it is necessary to electrically connect each of the terminals 14, 14, and to also make it possible to replace or positionally adjust the lappet 3. It should also be noted that, since many lappets 3 (i.e., close to 200 pieces in number) are provided on both sides of a ring frame, the insulating plate 16 and wiring board 15 employed therein are normally divided for 4 to 8 spindles, and therefore, these should be of the same type for convenience. It should further be noted that installing a large number of leads in the vicinity of the lappet bar 10 is disadvantageous. Accordingly, the wiring is so arranged that the signals from the individual snail wires can be respectively detected. More specifically, as shown in FIG. 3, the wiring boards 15 are so arranged as to be disposed next to each other, and for the electrical connections thereof, corresponding connecting portions provided at opposite side edges of the wiring boards are connected, while the connecting portions of the insulating plates 16 are formed by connecting plates 17, with said connecting plates 17 being provided so as to be pressed against the lappet bar 10 by the neighboring lappets. In other words, as shown in FIG. 6A (i.e. a cross sectional view taken along line (VI A—VI A in FIG. 2) and FIG. 6B (i.e. a cross sectional view taken along the line VI B—VI B in FIG. 2), with the wiring boards 15 being disposed on the lappet mounting face (front face) of the lappet bar 10, the insulating plates 16 are disposed to surround said wiring boards 15, and these members are fixed by lappet fixing bolts and nuts. It is to be noted that each bolt extended through the elongated opening 132 (FIG. 5) of the lappet bracket 13, an opening 162 formed in the insulating plate 16, a hole 151 of the wiring board 15 and a fixing hole of the lappet bar 10 so as to fix these members, and that the wiring board 15 is provided at one side face of the insulating plate through printed wiring.

The wiring board 15 disposed in the manner as described above has connecting portions 18, 18 for the terminals 14 formed at the upper portion of said fixing hole 151 for individual connection. Meanwhile, in the upper portion of the fixing hole 162 of the insulating plate 16, there is formed an elongated slot 161 so as to allow said terminals 14, 14 extending from the rear portion of the lappet 3 to pass therethrough. In other words, each of the terminals 14, 14 contacts the connecting portion 18 through the elongated slot 161 and constitutes the electrical path. For the electrical connections of the wiring boards 15, each of said wiring boards 15 is provided, at its opposite ends, with joint faces 19, 19 respectively which are formed symmetrically. On the other hand, each of the insulating plates 16 is made shorter in its length than the wiring board 15 at its opposite ends, so that the connecting portions of the wiring board 15 are spaced when the insulating plate 16 is joined to the writing plate 15, for filling such spaces by the connecting plate 17, with elastic terminals being provided at the mating face side of the connecting plate 17 so as to connect such joint faces 19, 19 with each other.

The electromotive force detecting means for the piezo-electric element 12 of the snail wire 2 constructed and mounted in the above described manner is shown by numeral 50 in FIG. 7, and so arranged that the two lead wires from the piezo-electric element 51 (12) are connected to a band amplifier 52 for selecting the earlier described inherent vibration frequency of the snail wire 2 in the signals from the piezo-electric element and subsequently amplifying said selected frequency by an amplifier 53 up to such a level as will be readily discriminated so as to convert the A.C. signal into a D.C. signal by a rectification and smoothing unit 54, while the region for the positive functioning is judged by a voltage comparator 55 for deriving a logic signal output 56.

Furthermore, since it is difficult, from the aspect of installation, to make the detecting means 50 to correspond to the individual lappets, the arrangement is so made that the detection and reporting be effected collectively. More specifically, for measuring the inherent vibrations of the piezo-electric elements 12 for the snail wires 2 provided in number close to 400 pieces per each one spinning frame, it is so arranged that the scanning thereof is made in a short period of time so as to effect the detection by transmitting signals of many A.C. signal sources onto the same bus line through scanning of shift registers.

Incidentally, for the snail wires 2 which detect the yarn breakage in the above described manner, it is required that they should sensitively produce the inherent vibrations to be generated, by the contact thereof with the spinning yarn Y, and simultaneously that their handling and maintenance are readily effected, while they are stably utilized over a long period. In other words, since it is troublesome to adjust the sensitivity of the snail wires or replace the same according to the kinds of the spinning yarns or due to alterations of the spinning conditions, such snail wires are required to be ones adaptable for various spinning yarns and spinning conditions.

DISCLOSURE OF THE INVENTION

Accordingly, it is a primary object of the present invention to provide an improved yarn breakage detecting snail wire arrangement which is capable of increasing the sensitivity of a piezo-electric element to be attached to said snail wire.

It is another important object of the present invention to provide an improved yarn breakage detecting snail wire arrangement of the above described type in which the piezo-electric element is not broken, even when the lappet is subjected to a rocking motion or the snail wire is applied with a downward impacts.

It is a still another object of the present invention to provide an improved yarn breakage detecting snail wire arrangement of the above described type which is capable of stably supporting the connections between the piezo-electric element and lead wires to be connected thereto over a long period.

In achieving these and other objects, according to the present invention, it is so arranged that, in the upper face side or lower face side of a piezo-electric element mounting flat portion of the snail wire, a concave groove intersecting at right angles with the axial direction of the snail wire is formed to provide a thin portion on the snail wire for sensitivity detecting the vibrations of the snail wire. Moreover, the piezo-electric element is arranged to be attached to the under face side of the snail wire so as to prevent damage to the piezo-electric element or further, the piezo-electric element attaching side end of the snail wire is filled with an elastic or resilient material which has a weaker elasticity or resiliency than that of a snail wire supporting resilient material so as to prevent lead wires connected to the piezo-electric element from being disengaged therefrom for a stable use over a long period.

More specifically, the piezo-electric element 12 stuck to the snail wire 2 is mounted to a flat portion 23 formed, for example, by rolling at one end of the snail wire 2, but there are cases where the detection of the inherent vibrations is not sufficiently effected for fine yarns, although no particular problem occurs in the case of coarse or thick yarns. In other words, for fine yarns, the vibrations are not sufficiently detected unless snail wires of thin material are employed. However, it is extremely inconvenient to replace or change snail wires each time the kinds of spinning yarns are altered.

Therefore, the object of the present invention is to provide a snail wire arrangement capable of detecting even a slight vibration with respect to fine yarns.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the severals views and wherein.

BEST MODE OF CARRYING OUT THE INVENTION

Figure 9:
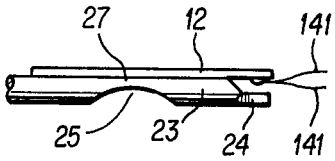
FIG. 9 is a frequentary side elevational view showing, on an enlarged scale, the snail wire of FIG. 8, FIGS. 10 and 11 are views similar to FIG. 9, which particularly show modifications thereof.
Figure 10:
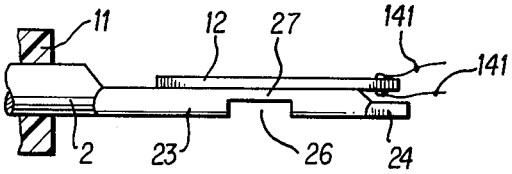
Figure 11:
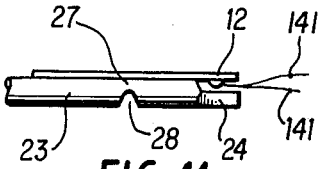

Referring now to the drawings, there is shown in FIG. 9 a main portion of a snail wire to which the present invention is applied. In FIG. 9, the snail wire 2 is formed, at its flat portion 23, with a curved concave groove 25 in the surface opposite (i.e. the lower face side in FIG. 9) to that where a piezo-electric element 12 is stuck, for the formation of a thin portion 27. The curved concave groove 25 is formed to intersect at right angles with the axial direction of the snail wire 2, and simultaneously, is positioned at approximately the central portion of the piezo-electric element 12 as shown. Furthermore, at one end portion of the flat portion 23, a stepped portion 24 is formed to make the flat portion still more flat. It is preferable to disposed terminal portions of lead wires 141, 141 to be connected to the piezo-electric element 12 at the above stepped portion 24. For the formation of the curved concave groove 25 and stepped portion 24, processing by press work is preferable, but these portions may alternatively be formed, for example, by cutting work. It is also to be noted that the thin portion 27 to be formed in the flat portion 23 is not limited to be formed by the curved concave groove 25 alone, but may be formed, for example, by a rectangular stepped concave groove as shown in FIG. 10 or by an inverted U-shaped slit 28 as shown in FIG. 11.

As described in the foregoing, when the thin portion 27 is formed in the piezo-electric element attaching portion of the snail wire 2, the sensitivity for the detection of vibrations produced in the snail wire 2 can be increased as much as 4 to 40 times that of the snail wire having no thin portion formed therein. The thickness of the thin portion 27 should suitably be in the range of 0.5 to 0.8 mm, and in this case, the width of the flat portion 23 (in the direction extending through the paper surface) should be in the range of 4 to 5 mm, with the thickness thereof being in the range from 1.5 to 2.0 mm. It should also be noted here that, in the foregoing embodiment, although the curved concave groove 25, the stepped concave groove 26 and the inverted U-shaped slit 28 are respectively shown as independently formed, the objects of the present invention may be satisfied, even if these grooves are provided in two to three pieces or are provided in combination.

On the other hand, since the piezo-electric element 12 is formed by an extremely brittle crystalline structure such as Rochelle salt or barium titanic acid and the like, into a thin rectangular piece so as to be stuck to the flat portion 23 of the snail wire 2, extra care should be taken not only in handling the snail wire 2, but in manipulation of the lappet 3.

Figure 8:
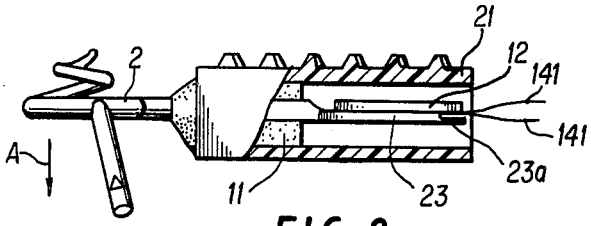
FIG. 8 is a side elevational view, partly broken away, showing a snail wire portion with a snail wire holder shown in FIG. 5, to which the present invention is applied.
Figure 12:
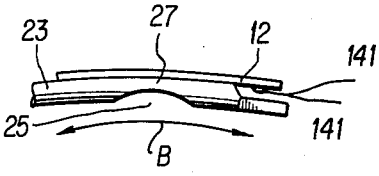
FIG. 12 is a view similar to FIG. 9, which is explanatory of breakage of the piezo-electric element.

However, there are cases where the piezo-electric element 12 is broken in spite of the extreme attention directed thereto, and troublesome procedures are required for detecting such broken piezo-electric element. Accordingly, the present inventor has made investigations as to how such breakage takes place. As a result, the findings are such that, as shown in FIG. 8, the snail wire 2 is inserted into the holder 21 through the resilient support member 11, and the running spinning yarn acting on the snail wire 2 presses the snail wire 2 in the direction indicated by the arrow A. Meanwhile, as one of the couses for the breakage of the spinning yarn, there are such cases where the yarn becomes entangled with the snail wire 2 so as to be thrown about, and is pulled in the direction of the arrow A for being broken. Moreover, in some cases, roving bobbins or empty bobbins, etc. may accidentally be dropped onto the snail wire 2 for generating an impact force in the direction of the arrow A. Such actions and impact force tend to undesirably bend the flat portion 23 of the snail wire 2 as shown by the arrow line B in FIG. 12. Especially, in the snail wire in which the thin portion 27 is to be formed on the flat portion 23 as described earlier, the bending is so large that the piezo-electric element 12 is curved thereby, and thus, said piezo-electric element 12 can not follow the bending of the flat portion 23, and is consequently broken.

Figure 13:
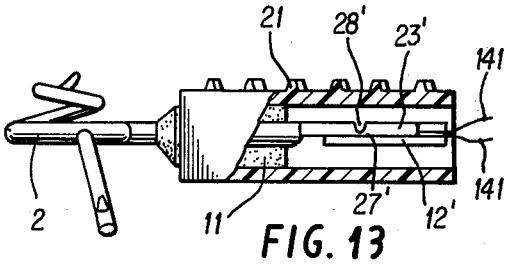
FIG. 13 is a side elevational view, partly broken away, showing a snail wire arrangement according to the present invention.

Incidentally, it has been found that the piezo-electric element 12, although weak against extension forces, has a considerable resistance against compression forces, and that, accordingly, the breakage of the piezo-electric element 12 to be stuck to the snail wire 2 may be reduced, if the piezo-electric element is attached to the surface inside the bending line arrow B, i.e. to the side face thereof opposite (the lower face side) to the direction of advance of the spinning yarn with respect to the snail wire 2. FIG. 13 shows the structure wherein the snail wire 2 arranged as above is provided on the holder 21. More specifically, in FIG. 13, the flat portion 23′ of the snail wire 2 is formed at the top surface side of the snail wire 2, with the piezo-electric element 12′ being applied onto the top surface side. Meanwhile, the thin portion 27′ to be formed at the flat portion 23′ is shown as formed by the U-shape slit 28′. It is to be noted that the thin portion to be formed may be in the form of the curved concave groove or the stepped concave groove as described earlier. In the snail wire 2 having the construction as described above, the undesirable breakage of the piezo-electric element 12 due to bending, while displaying resistance against compression, is reduced to minimum. Additionally, the piezo-electric element show no deterioration with respect to the detection of the inherent vibration, and can be stably used for the purpose.

Figure 1:
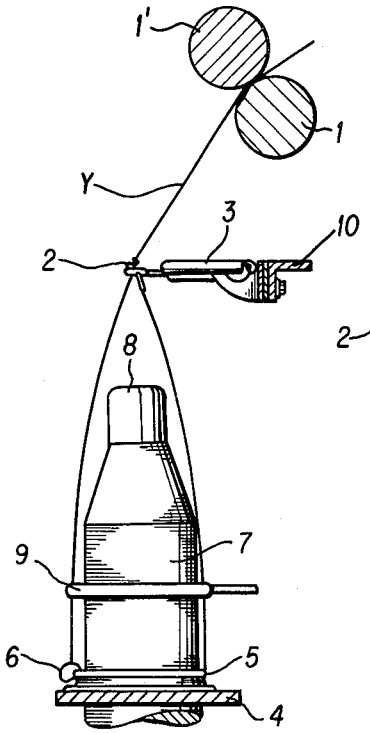
FIG. 1 PRIOR ART
FIG. 1 is a schematic side elevational view of a spun yarn take-up portion of a conventional ring frame.
Figure 2:
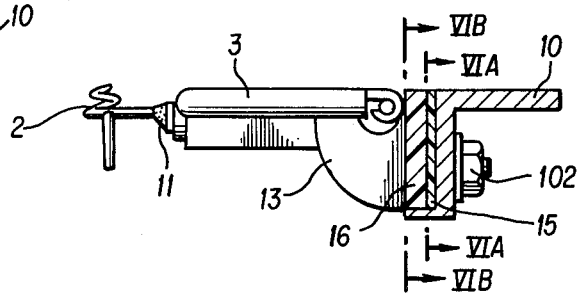
FIG. 2 PRIOR ART
FIG. 2 is a side elevational view of a conventional lappet to which a yarn breakage detecting snail wire is attached.
Figure 4:
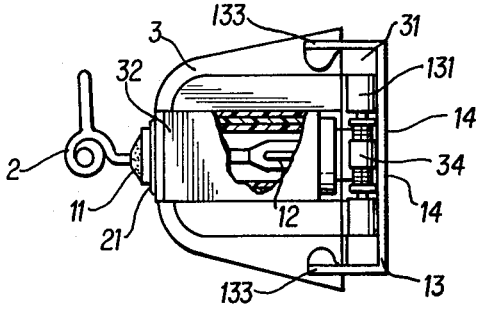
FIG. 4 PRIOR ART
FIG. 4 is a bottom plan view, partly broken away, of the lappet of FIG. 2.
Figure 3:
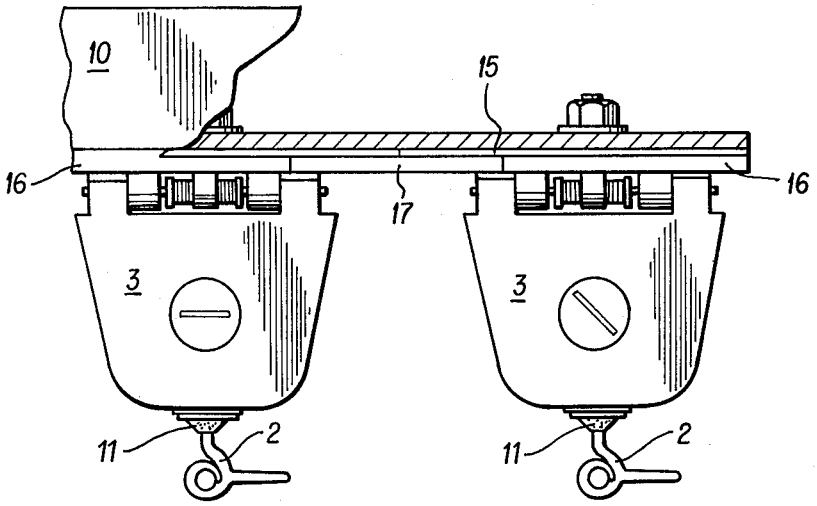
FIG. 3 PRIOR ART
FIG. 3 is a top plan view of the lappet of FIG. 2.
Figure 5:
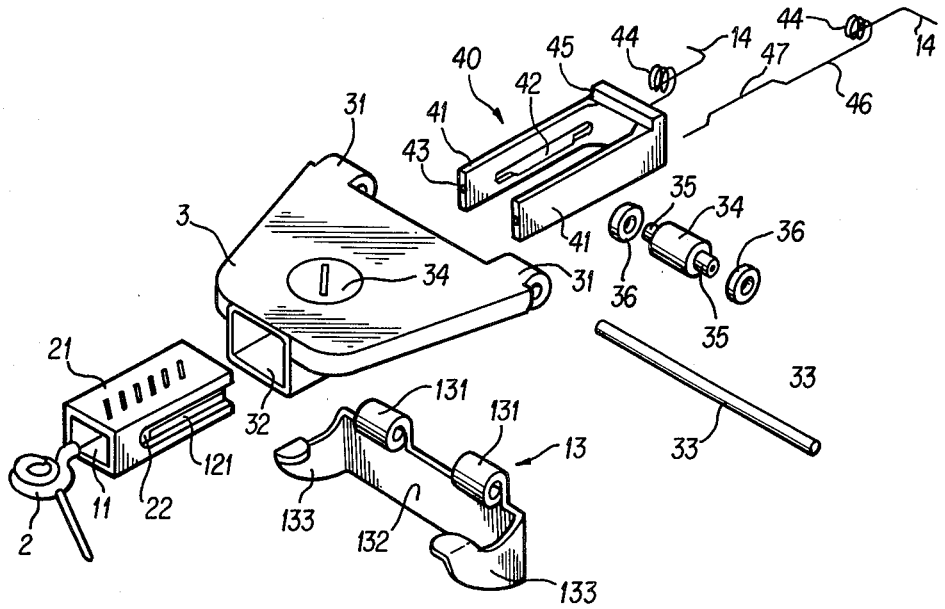
FIG. 5 PRIOR ART
FIG. 5 is an exploded view showing an arrangement of the lappet and snail wire.
Figure 6:
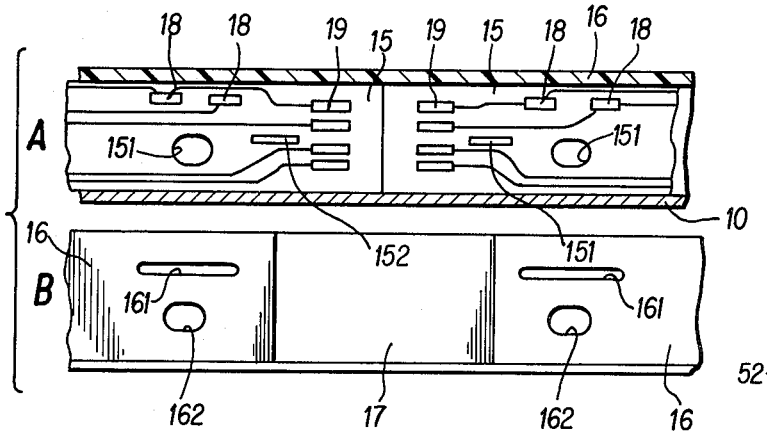
FIG. 6 PRIOR ART
FIG. 6A is a cross section taken along the line VI A—VI A in FIG. 2.
FIG. 6B is a cross section taken along the line VI B—VI B in FIG. 2.
Figure 7:
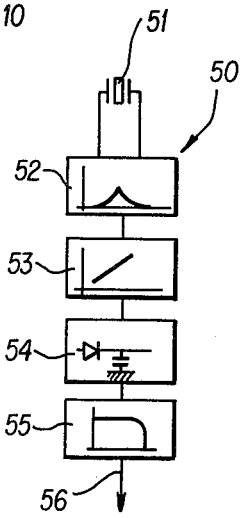
FIG. 7 PRIOR ART
FIG. 7 is a schematic block diagram explanatory of conventional signal detection.

On the other hand, the lead wires 141, 141 to be connected to the piezo-electric element 12 are respectively soldered to the terminals provided at end portions of the piezo-electric element 12, while the other ends thereof are respectively soldered to the electrically conductive plates 121 (FIG. 5) which are provided at the opposite sides of the holder 21. Meanwhile, the lead wires 141 as described above are required to be wired in the narrow space, and simultaneously, not to obstruct the generation of vibrations of the snail wire 2. Accordingly, for the leads 141, fine wires with superior flexibility must be employed. Furthermore, since the connections with respect to the piezo-electric element 12 should be formed in a narrow space so as to be accommodated in the stepped portion 24, such connections tend to be disconnected, thus often resulting in problems due to breakage. As countermeasures to such problems, investigations have been made into various arrangements such as formation of the terminals of the piezo-electric element 12 at the rear end face of said element 12 or at the opposite surface side of the stepped portion 24, and it has been found that the arrangement in which said soldered terminals of the piezo-electric element 12 and part of said leads 141, 141 are embedded and held, through a resilient member, in the holder 21, is favorable. The embedded resilient member as described above is to be formed by the use of a material which is softer and more resilient than that of the support resilient member 11 of the snail wire 2.

Figure 14:
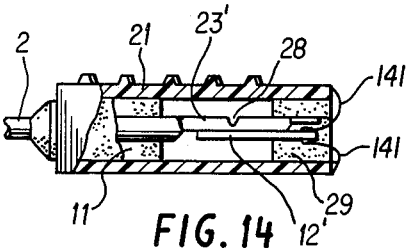
FIGS. 14 and 15 are views similar to FIG. 13 showing further modifications of the snail wire arrangements of the present invention.

FIG. 14 shows the yarn breakage detecting snail wire 2 arranged in the above described manner, and the snail wire 2, flat portion 23′ and piezo-electric element 12′ to be stuck are those as applied to the arrangement of FIG. 13. More specifically, the rear end portion of the flat portion 23′ is arranged to be held together with the rear end of the piezo-electric element 12′ and connections of the leads 141 within the holder 21, through the embedded resilient member 29. For the embedded resilient member 29, any suitable elastic or resilient material may be employed, and in the case of the embedding, it may be so arranged as to form the rear end side of the assembled holder 21 through immersion into a soft resilient resin solution, or to insert with the holder 21 after assembling these onto the snail wire 2. Furthermore, as a favorable example of such resilient material, it has been found to be advantageous to set the hardness of the wire support resilient member in the region of 37 to 43 degrees, and that of the embedded resilient member 29 in the range of 15 to 20 degrees.

Figure 15:
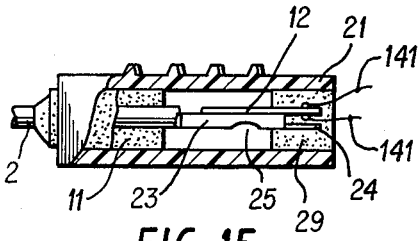
Figure 16:
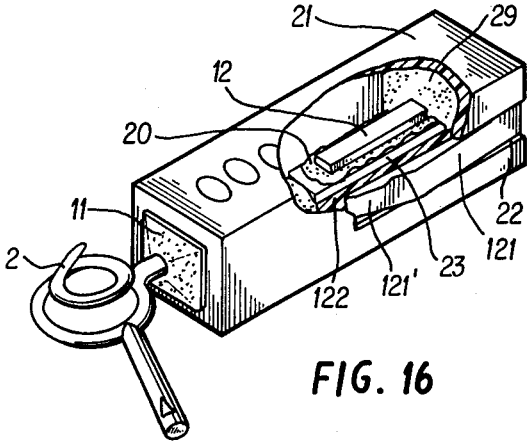
FIG. 16 is a perspective view, partly broken away, showing the construction of the snail wire holder to which the present invention is applied.

In the yarn breakage detecting snail wire having the construction as described above, the lead connecting portions of the piezo-electric element 12 are held by the soft resilient member, the disengagement of the connections due to vibrations of the snail wire 2 and impact force is advantageously eliminated, and the breakage of the leads 141 is also prevented, while the piezo-electric element 12 does not deteriorate in its sensitivity for stable functioning over a long period. It is to be noted that the embedded resilient member 29 may be applied to the snail wire of FIG. 9 to satisfy the object of the present invention as specifically shown in the embodiment of FIG. 15. FIG. 16 shows one example of the arrangement for the yarn breakage detecting snail wire applied with the construction as described above. In the arrangement of FIG. 16, the flat portion 23 of the snail wire 2 is disposed at the central portion of the holder 21 along the longitudinal direction of the holder 21, and the piezo-electric element 12 is disposed, with a bonding agent 20 being applied to be raised therearound. Meanwhile, the snail wire 2 constructed as in FIG. 15 is disposed, and the embedded resilient member 29 is formed through immersion into the soft resilient resin solution. In the above embodiment, the conductive plates 121 to be disposed in the grooves 22 formed at the opposite sides of the holder 21 are shown as arranged so as to be stably held in the grooves 22. More specifically, at the forward end portions (at the left side in the drawing) of the grooves 22, openings 122 communicated with the interior of the holder 21 are preliminarily formed, and narrow width portions 121' are provided at the forward end sides of the conductive plates 121 so as to be bent for engagement with said openings 121. Meanwhile, the leads 141 as described earlier are respectively soldered with the conductive plates 121' at the rear end portions of the holder 21, and depending on the necessity thereof, the above solder connections are also arranged to be embedded by the bonding agent 20 for being further supported by the embedded resilient member 29.

By the arrangement according to the present invention as described above, the yarn breakage detecting snail wire of the present invention is capable of extremely sensitively detecting the inherent vibrations resulting from the contact with the spinning yarns, and is also capable of preventing breakage of the piezoelectric element 12, while, owing to the arrangement that the lead connections thereof are embbed and held by the soft resilient material, problems arising due to breakage are appreciably reduced, and thus, snail wires which can be stably used over a long period are obtained, thus making it possible to perform an efficient control for the yarn breakage detection and management of yarn breakage in the ring frames.

In the management of yarn breakage achieved by the application of the snail wire according to the present invention, not only the momentary yarn breakage in the ring frame, but the magnitude of yarn breakage according to frames, their left and right rows, specific groups, and spindles, may be detected, thereby assisting investigation into the causes of the yarn breakage. Additionally, the findings by the yarn breakage detection as described above may be utilized for increasing or decreasing the suction force of a pneumatic clearer to be simultaneously installed on the ring frame, for adjusting the spinning speed, for turning ON or OFF or for adjustments of illumination intensities of working illumination lamps.

While the present invention has been described in detail by way of examples with reference to the accompanying drawings, it should be noted that various modifications and variations are apparent to those skilled in the art. Accordingly, unless otherwise these modifications and variations depart from the scope of the present invention, they should be construed as included therein.

What is claimed is:

1. A yarn breakage detecting snail wire arrangement for ring frames and the like comprising:

a lappet;

a holder inserted into said lappet;

a resilient support member;

a snail wire supported, through said resilient support member, by said holder inserted into said lappet so as to contact running spinning yarns for producing inherent vibrations at a side portion of said snail wire; and a piezo-electric element attached to a portion of said snail wire so as to detect said inherent vibrations for detecting presence of running spinning yarns, said snail wire being formed, at said portion thereof attached to said piezo-electric element along the face portion thereof, into a flat-shaped portion, said flat-shaped portion having a groove formed therein at a side face portion thereof opposite to said face portion attached to said piezo-electric element, and at approximately a central portion of said piezo-electric element in a direction intersecting at right angles with the axial direction of said snail wire so as to form a thin portion in said face portion of said snail wire attached to said piezo-electric element.

2. A yarn breakage detecting snail wire arrangement as claimed in claim 1, further comprising means for attaching said piezo-electric element mounted on said face portion of said snail wire to the side of the snail wire opposite a direction of advance of said spinning yarns running in contact with said snail wire.

3. A yarn breakage detecting snail wire arrangement as claimed in claims 1 or 2, further comprising:

a plurality of leads connected to a rear end portion of said piezo-electric element; and an embedded resilient member for connecting said snail wire and said leads to said rear portion of said piezo-electric member wherein said embedded resilient member further comprises a material softer and more resilient than that of said snail wire resilient support member.

* * * * *